US006325473B1

(12) United States Patent
Brüstle et al.

(10) Patent No.: US 6,325,473 B1
(45) Date of Patent: Dec. 4, 2001

(54) PULL-OUT GUIDE FOR DRAWERS

(75) Inventors: Klaus Brüstle, Höchst; Helmut Hollenstein, Lustenau; Erich Röck, Höchst, all of (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 179 days.

(21) Appl. No.: 08/609,991

(22) Filed: Feb. 29, 1996

(30) Foreign Application Priority Data

Mar. 9, 1995 (AU) ..... GM133/95

(51) Int. Cl.[7] ..... A47B 88/00

(52) U.S. Cl. ..... 312/334.13; 313/334.6; 313/334.12

(58) Field of Search ..... 312/334.24, 334.27, 312/334.6, 334.7, 334.13, 334.14, 334.15, 334.12

(56) References Cited

U.S. PATENT DOCUMENTS 4,176,890 12/1979 Gorton .

FOREIGN PATENT DOCUMENTS 27 31 953 1/1978 (DE) .
38 32 701 3/1990 (DE) .
94 13 108 1/1995 (DE) .
0 613 639 9/1994 (EP) .

*Primary Examiner*—Peter M. Cuomo
*Assistant Examiner*—Stephen Vu
(74) *Attorney, Agent, or Firm*—Wenderoth, Lind & Ponack, L.L.P.

(57) ABSTRACT

A pull-out guide for a drawer includes a carcass-side supporting runner and a drawer-side pull-out runner on each side of the drawer. A respective roller is supported on each runner. Running flanges of the pull-out runners cover running flanges of the supporting runners. The pull-out runners have horizontally projecting fins which are disposed below the running flanges of the pull-out runners and which have free ends projecting to below the running flanges of the corresponding supporting runners in such a way that the pull-out runners are secured against unintentional lifting off from the supporting runners.

16 Claims, 6 Drawing Sheets

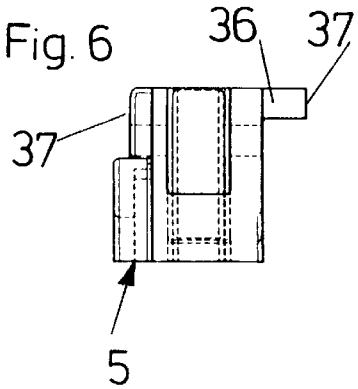
Fig. 6
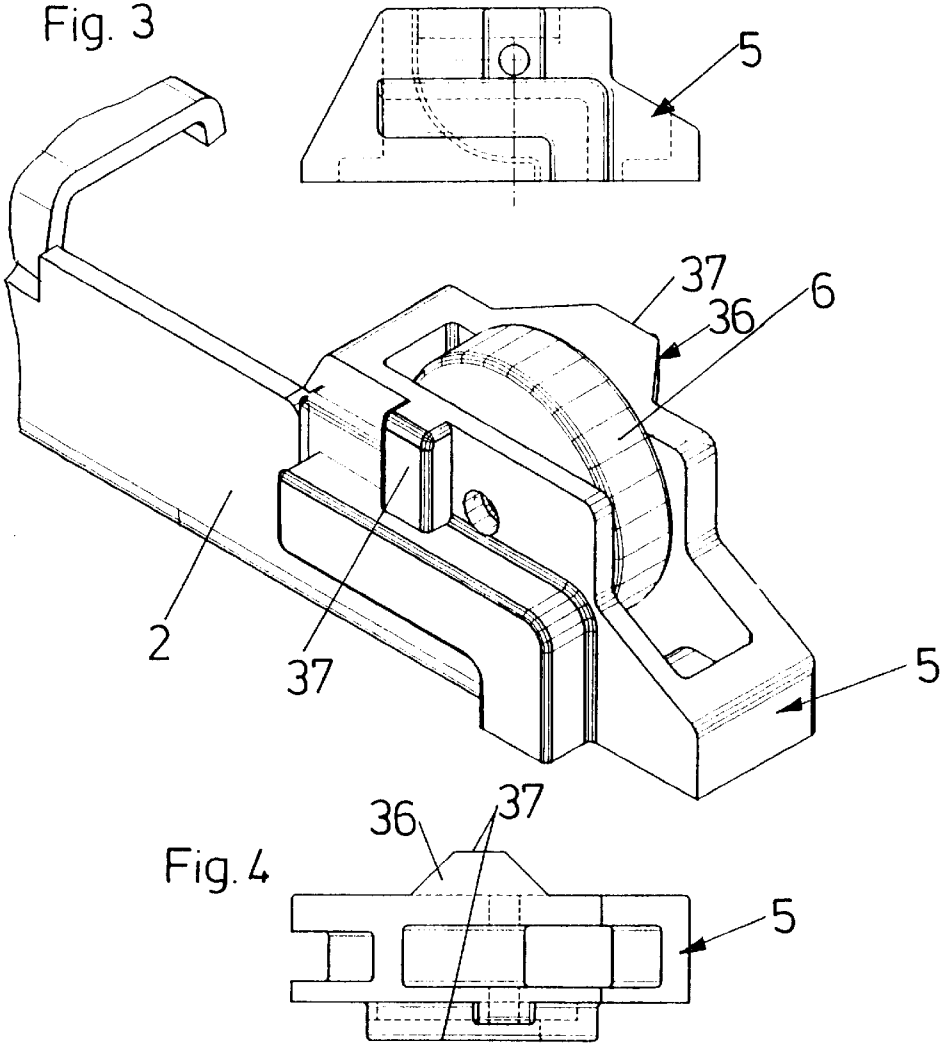
Fig. 5
Fig. 3
Fig. 4

PULL-OUT GUIDE FOR DRAWERS

BACKGROUND OF THE INVENTION

The invention relates to a pull-out guide fitting for a drawer and including a carcass-side supporting runner or rail and a drawer-side pull-out runner or rail on each side of the drawer. A running member such as a roller or the like is supported on each runner. The roller of each pull-out runner is guided between two running flanges of the respective supporting runner and the running flange of each pull-out runner covers the two running flanges of the associated supporting runner.

The best running properties of such pull-out guide are achieved with rollers. In some cases, generally for reasons of cost, plastic slides are used instead of rollers.

SUMMARY OF THE INVENTION

The object of the invention is to provide an improved pull-out guide fitting of this type.

Such object according to the invention is achieved in that the pull-out runners have horizontally projecting fins which are disposed below the running flanges of the pull-out runners and which have free ends projecting beneath the upper running flanges of the corresponding supporting runners in such a way that the pull-out runners are secured against unintentional lifting off from the supporting runners.

In order to reduce the unintentional lifting of the drawer to a minimum and thereby to prevent a stop at the front end of the supporting runner from being overrun, it is advantageously provided that in a manner which is known per se the supporting runners have free edge flanges against which the fins of the lifted pull-out runners strike.

A good lateral guiding of the pull-out guide with a simultaneous increase in loading capacity is achieved by providing the running flange of one of the pull-out runners with a longitudinally extending bead, the side walls of which are guided on the roller which is supported on the supporting runner.

A further embodiment of the invention provides that the rollers of the supporting runners are supported in respective plastic blocks, each of which is provided with a laterally projecting stop for the fins of the respective pull-out runner. Spindles of the rollers are mounted at both ends thereof in walls of the plastic blocks. In this way a very stable support of the rollers is achieved. The plastic block advantageously has lateral guide surfaces for the pull-out runner, so that a lateral guide is also provided for a drawer which is largely pulled out of the carcass or body of an article of furniture. Moreover, when the drawer is pulled out and pushed in, smooth running is ensured by plastic and metal sliding of one another. In order to facilitate a rapid installation of the plastic block without tools, in an advantageous embodiment of the invention each supporting runner which has lower and upper running flanges and the lower running flange has stamped-out fins below which project projections of the plastic block.

A rapid installation of the supporting runners in the carcass of the article of furniture is achieved in that the supporting runners are fixed on the furniture carcass by means of separate retaining plates which are disposed at the front end and at the rear end of each supporting runner. In one embodiment at least one of the retaining plates is provided with a hook which engages in a punched hole in the supporting runner. In this construction the supporting runner merely needs to be pressed onto the retaining plate, the hook engages in the punched hole and thus the supporting runner is anchored in the furniture carcass. It is advantageously provided that the retaining plate at the rear end of the supporting runner rests on an end face of the supporting runner and has upper and lower retaining tabs which jut out in the longitudinal direction of the supporting runner, the hook being constructed on at least one of the tabs. In this way the rear end of the supporting runner can be rapidly anchored on the retaining plate without having to be fixed by means of a tool.

In order to ensure that the supporting runners are held in correct alignment, in a further embodiment of the invention it is proposed that the retaining tab opposite to the hook has a projection which can be pushed into a slot which is open to the rear in a horizontal flange of the supporting runner. Advantageously the projection is received with clearance in the slot on one side of the drawer, while on the other side of the drawer it engages tightly in the slot.

In another embodiment the rear retaining plate is constructed on a lower flange thereof with two knobs which receive the supporting runner therebetween with a clearance. An upper retaining tab is of resilient construction and has a bend by means of which it retains and grips the supporting runner. In this way the alignment of the supporting runner deep inside the piece of furniture can be easily corrected. For example, the supporting runner can be mounted at the front thereof by the front retaining plate by screws to a furniture frame, and is supported without screws by the rear supporting plate.

BRIEF DESCRIPTION OF THE DRAWINGS

Embodiments of the invention are described in detail below with reference to the accompanying drawings, wherein:

FIG. 3 is a perspective view of a front end of a supporting runner and of a plastic block;

FIG. 4 is a top view of the plastic block;

FIG. 5 is a side view of the plastic block;

FIG. 6 is an end view of the plastic block;

DETAILED DESCRIPTION OF THE INVENTION

Figures 12, 13:
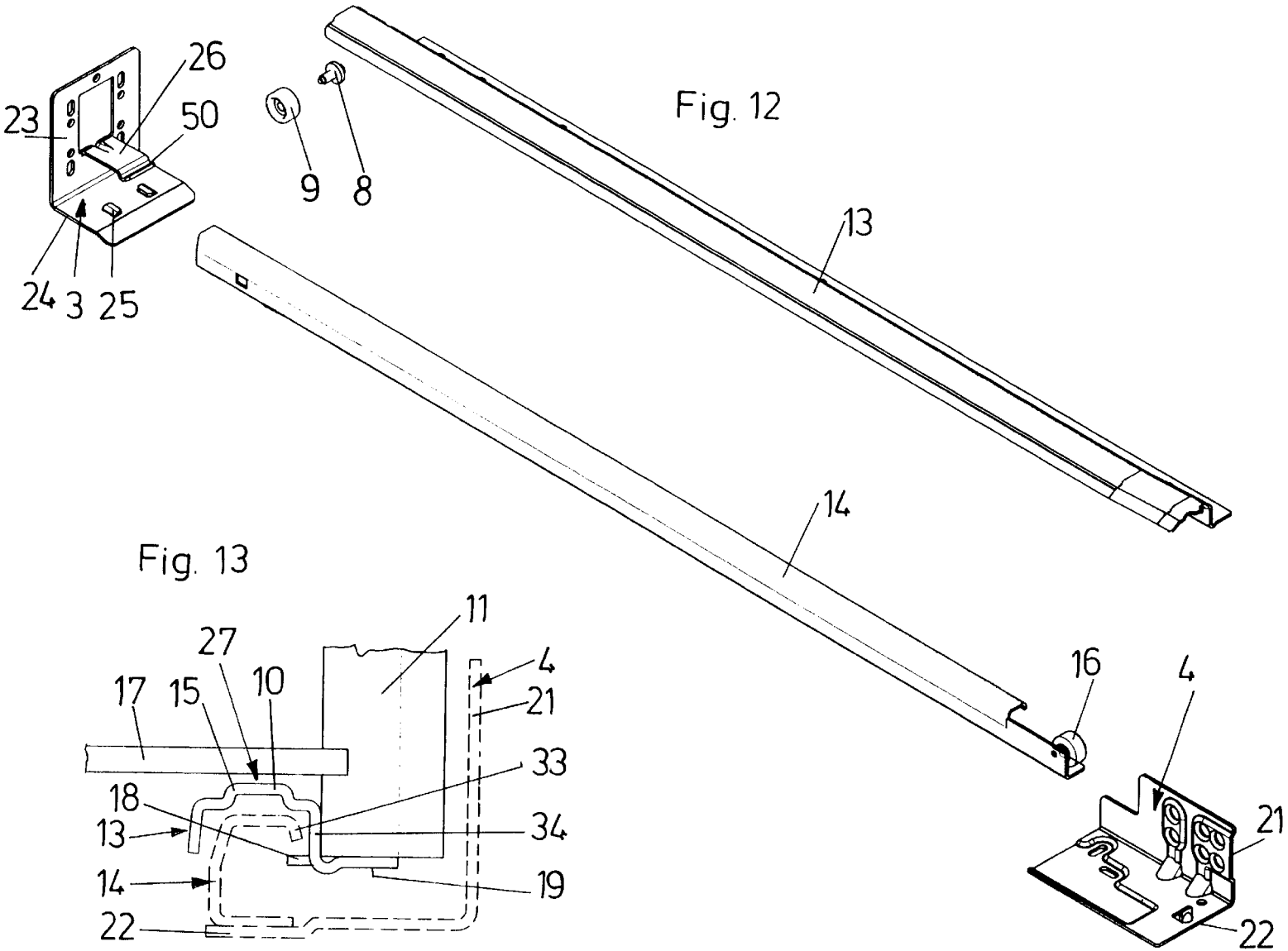
FIG. 12 is an exploded perspective view of a supporting runner, a pull-out runner and a retaining plate according to further embodiment of the invention.
FIG. 13 is a cross-section through runners of such embodiment.
Figure 16:
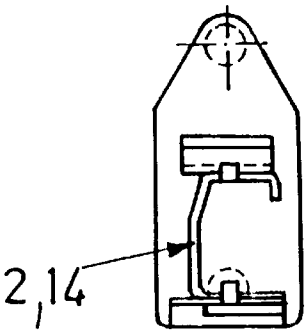
FIG. 16 is a front view of a retaining plate.
Figure 17:
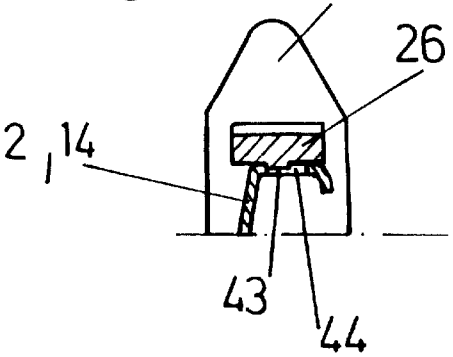
FIG. 17 is a partial section of an upper region of the retaining plate.

A pull-out guide fitting for use on each side of a drawer includes a pull-out runner or rail 1 (FIG. 1) or 13 (FIG. 12) and a supporting runner or rail 12 (FIG. 1) or 14 (FIG. 12). The pull-out runner 1, 13 is fixed below a drawer bottom 17 in a conventional manner by a horizontal fixing flange 19 on a lower edge of a side wall 11 of the drawer, e.g. preferably by screws.

Figure 15:
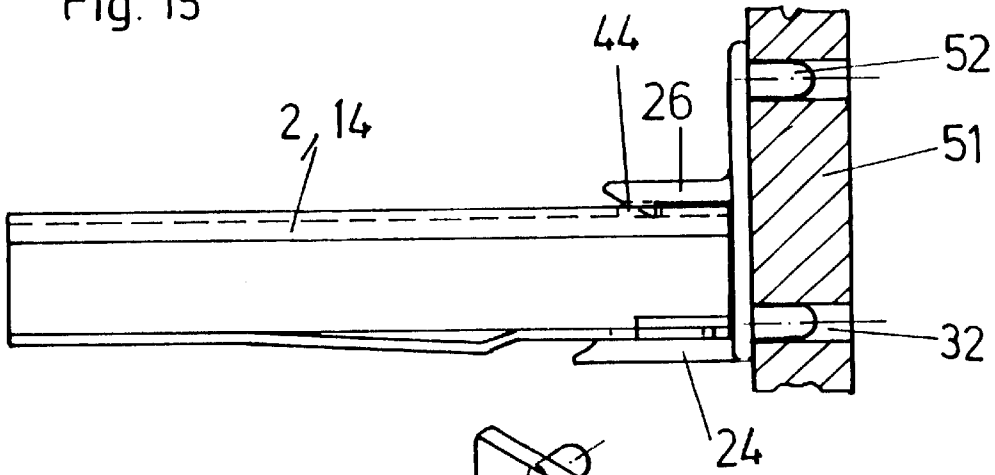
FIG. 15 is a side view of the rear end of the supporting runner.
Figure 14:
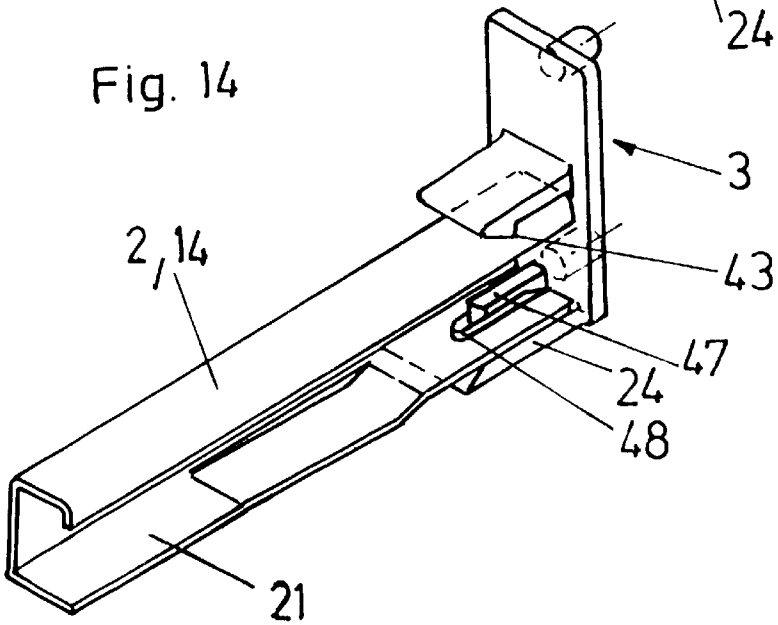
FIG. 14 is a perspective view of the rear end of a supporting runner.

The supporting runner 2, 14 is mounted by means of retaining plates 3, 4 on a carcass or cabinet of an article of furniture, one retaining plate 4 being mounted at the front end and one retaining plate 3 at the rear end of the supporting runner 2, 14. The retaining plate 4 which supports the front end of the supporting runner 2 is screwed to a side wall of the article of furniture or to an upright of a furniture frame thereof. The retaining plate 4 has a vertical portion 60 which serves for fixing to the side wall or the frame of the article of furniture and a horizontal portion 22 which supports the supporting runner 2. The rear retaining plate 3 likewise has a vertical portion 23 which is fixed on a rear wall 51 of the article of furniture, for example by means of pegs 52 (FIG. 15), and a horizontal portion 24 which supports the rear end of the supporting runner 2, 14.

Figures 1, 2:
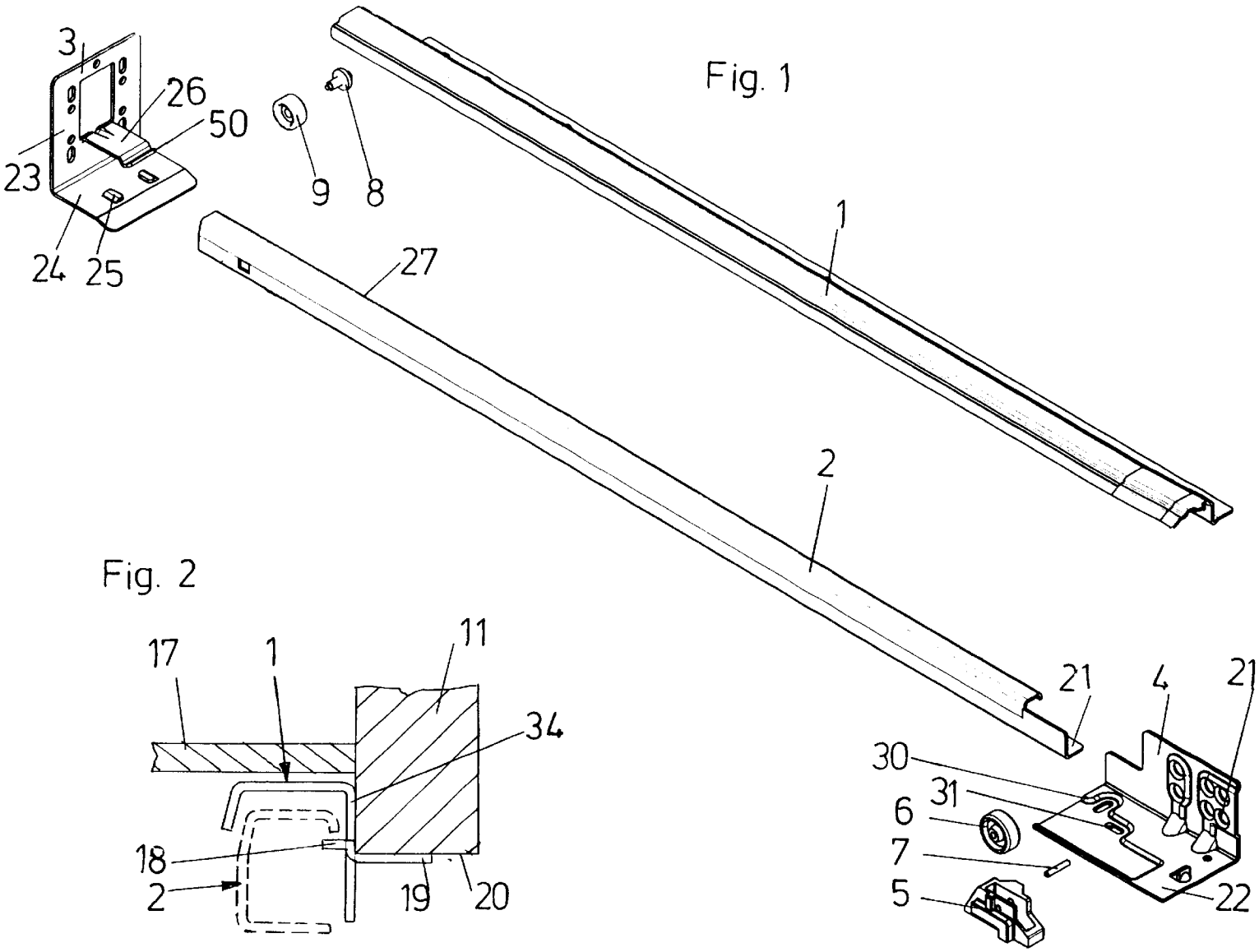
FIG. 1 is an exploded perspective view of parts of a pull-out guide fitting.
FIG. 2 is a cross-section through a lower corner of a drawer and a-guide fitting attached thereto.
Figure 7:
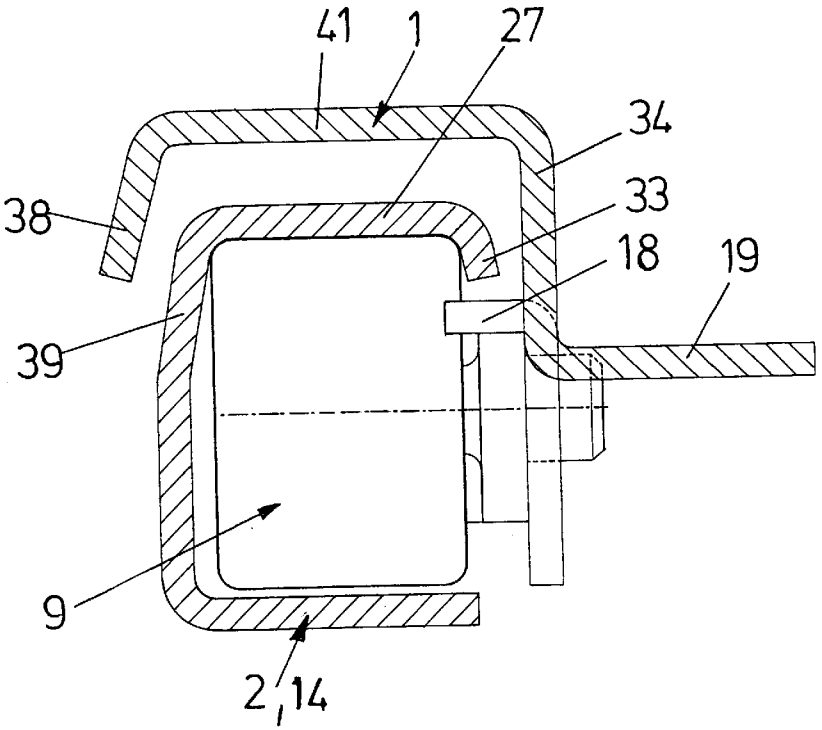
FIG. 7 is a cross-section through a side of a pull-out guide fitting in the region of a load-side roller.
Figure 8:
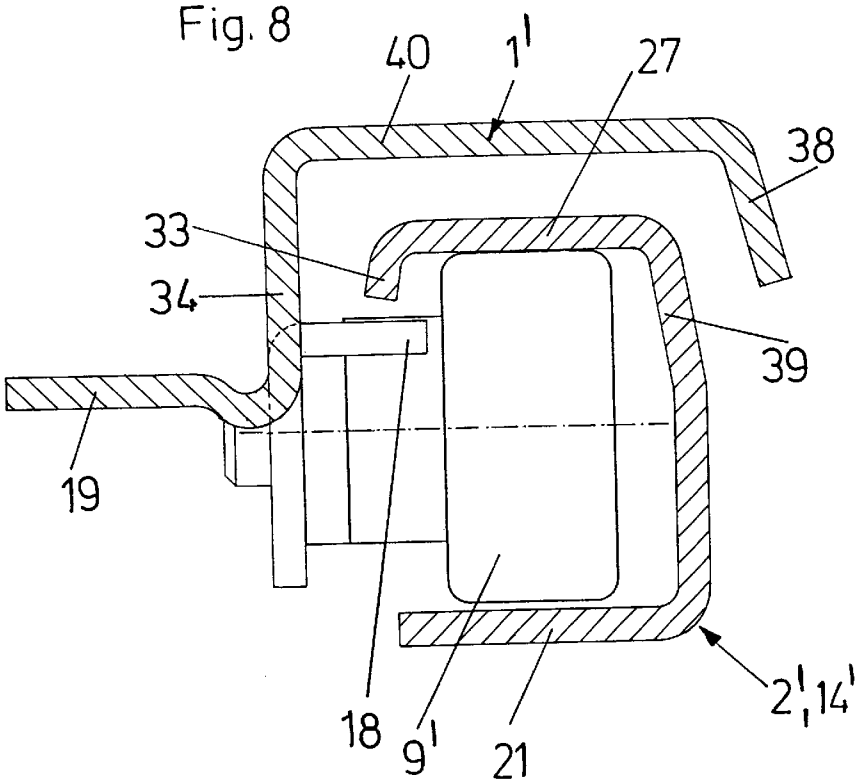
FIG. 8 is a similar cross-section on the other side of the drawer.

In the embodiments according to FIGS. 1 and 12, the horizontal portion 24 has two limiting knobs 25 which receive therebetween the rear end of the supporting runner 2, 14 with a clearance so that the supporting runner 2, 14 is prevented from being pushed too far to the side when subjected to a lateral load. The retaining plate 3 has a further horizontal retaining tab 26 which in the assembled position rests on an upper running flange 27 of the supporting runner 2, 14. In the embodiments according to FIGS. 1 and 12 the retaining tab 26 is of resilient construction and has a bend 50 with which it presses onto the supporting runner 2, 14. The supporting runner 2, 14 is therefore retained and gripped by the retaining plate 3.

In the embodiment according to FIGS. 14 to 17 a hook 43 constructed on the retaining tab 26 engages in a punched hole 44 in the horizontal flange 27 of the supporting runner 2. The lower retaining tab 24 has a projection 47 which in the assembled state protrudes into a slot 48 which is open to the rear in lower horizontal flange 21 of the supporting runner 2, 14. Advantageously, on one side of the drawer the projection 47 is received tightly in the slot 48 in order to provide lateral positioning for the supporting runner 2, 14. On the other side of the drawer the projection 47 is advantageously of narrower construction than the width of the slot 48. As a result, the supporting runner 2, 14 on such other side of the drawer can be moved laterally and in this way any inaccuracies of assembly which occur can be compensated.

Figure 9:
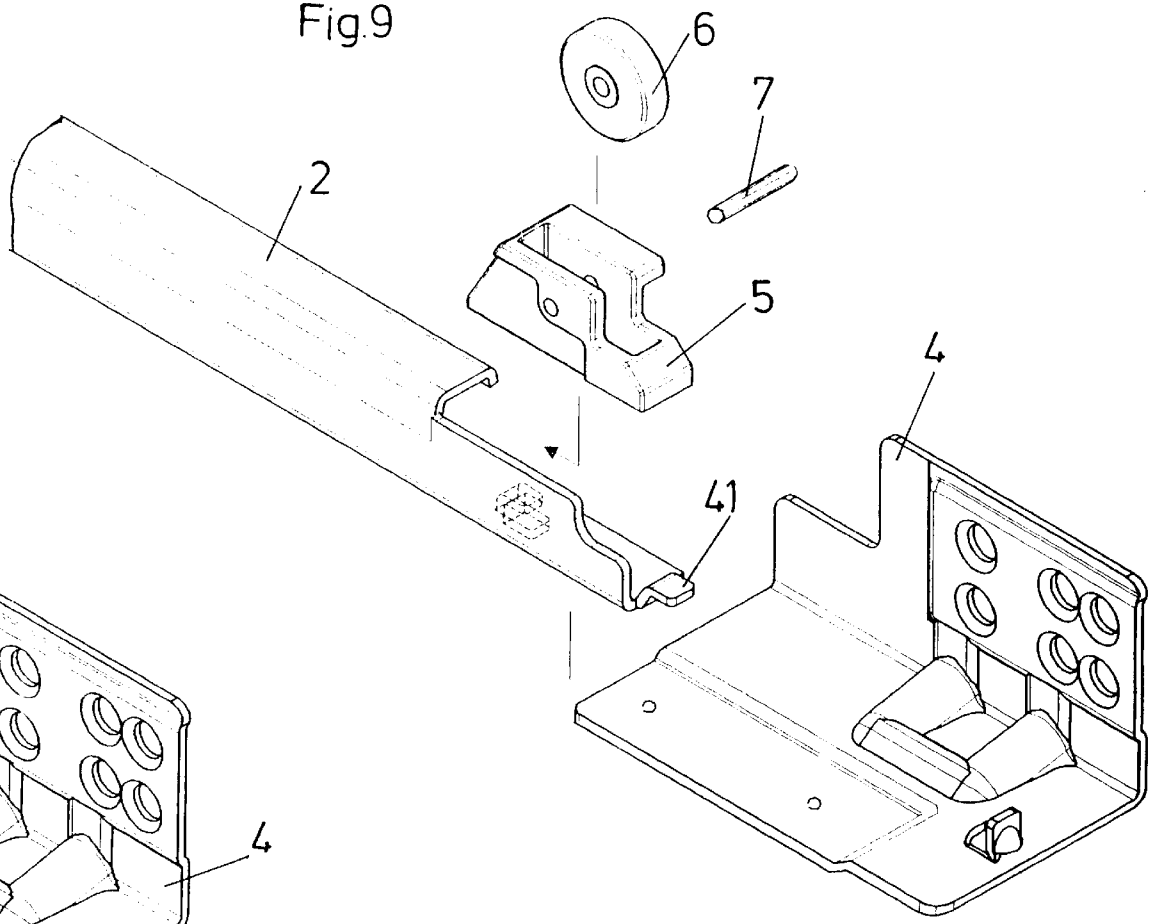
FIG. 9 is an exploded perspective view of the front end of a supporting runner, a plastic block and a retaining plate according to a further embodiment of the invention.
Figure 10:
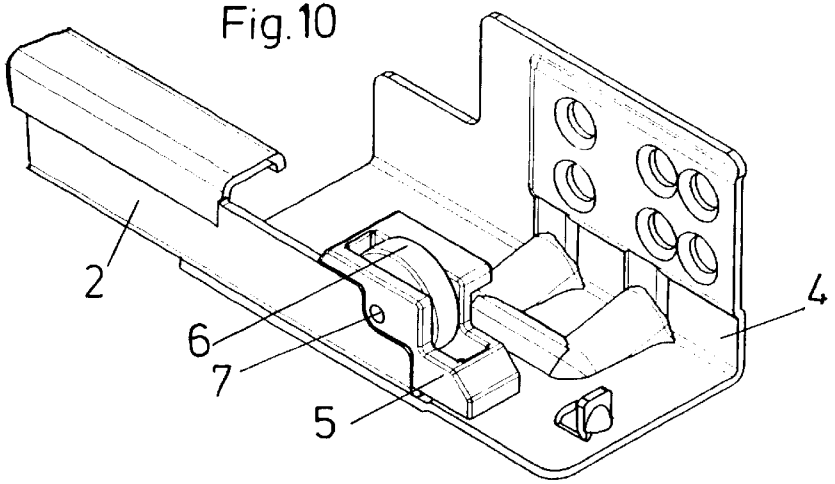
FIG. 10 is a perspective view of the front end of the supporting runner with the plastic block and the retaining plate in an assembled state.
Figure 11:
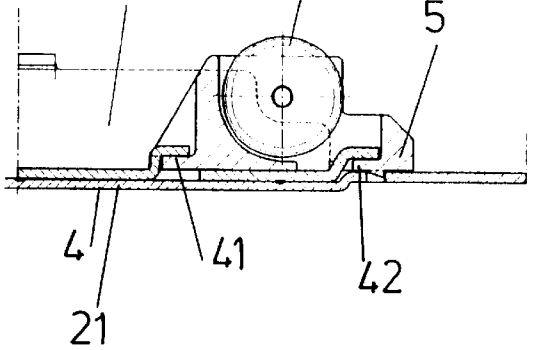
FIG. 11 is a longitudinal section through the front end of the supporting runner and the plastic block of the embodiment shown in FIGS. 9 and 10.

The supporting runner 2, 14 is provided at the front end thereof with a running member in the form of a roller 6 (FIG. 1) or 16 (FIG. 12). In the embodiment according to FIGS. 1 to 11 the roller 6 is mounted by means of a spindle 7 in a plastic block 5 which is anchored on a horizontal flange 21 of the supporting runner 2 or on the portion 22 of the retaining plate 4. As indicated in FIGS. 9–11, the lower running flange 21 of the supporting runner 2 has punched from the material thereof upwardly extending lugs or fin members 70 that extend generally horizontally. The plastic block 5 has projections 42 which fit beneath respective of the lugs or fin members 70, thereby mounting plastic block 5 on the supporting runner 2. In FIGS. 12–13, supporting runner 14 is fixed on the retaining plate 4 by means of rivets (not shown) or the like or is welded thereto. The retaining plate 4 can be fixed on the furniture carcass by means of fixing screws which project through slots 30, 31 aligned at right angles to one another in horizontal portion 22 or through holes in vertical portion 60.

During assembly, the rear retaining plate 3 can be fixed, for example screwed, to the rear wall 51 of the piece of furniture, whereafter the rear end of the supporting member 2, 14 is pushed onto the retaining plate 3. In the embodiment according to FIGS. 14 to 17, in which the retaining plate 3 is provided with lugs 52, the retaining plate 3 can be pushed onto the rear end of the supporting runner 2, 14, whereupon the latter is pressed with the retaining plate 3 onto the rear wall 51 of the piece of furniture and the lugs 52 are pushed into bores 32 in the rear wall 51 of the piece of furniture. Then the front end of the supporting runner 2 is fixed by means of the retaining plate 4.

The upper running flange 27 of the supporting runner 2 is limited by a free edge flange 33. At least one horizontal fin 18 is bent out of vertical flange 34 of the pull-out runner 1, 13 and a free end of fin 18 projects under the limiting flange 33 of the supporting runner 2, 14. Advantageously three horizontal fins 18 are provided and are distributed over the length of the pull-out runner 1, 13. These fins prevent unintentional lifting of the drawer and disengagement of the pull-out runners 1, 13 from their anchoring in the supporting runners 2, 14. The plastic block 5 is advantageously provided with a counter-stop 36 on which a stop 18 of the pull-out runner 1 comes to rest when the drawer is lifted, so that a drawer which is largely pulled out of the furniture carcass is also secured against unintentional lifting. Furthermore, the plastic block 5 has lateral guide surfaces 37 which are guided between the vertical flange 34 and an outer limiting flange 38 of the pull-out runner 1, so that a good lateral guiding of the drawer is ensured.

Running members in the form of rollers 9, 9' of the pull-out runners 1, 13 are mounted on the pull-out runners 1, 13 in a conventional manner by rivets 8. In this case the width of the roller 9 on one side of the drawer is preferably chosen so that it is exactly guided by the upper horizontal flange 27 of the supporting runner 2, 14 and lateral limiting flanges 33, 39 thereof, so that a lateral guide of the drawer is also achieved in the rear region thereof. In order to be able to compensate for inaccuracies in the assembly of the furniture carcass, of the drawer or also of the fittings on the furniture carcass or on the drawer, it is provided that the roller 9' on the other side of the drawer is narrower than the distance between the lateral limiting flanges 33, 39. The roller 9' and thus the drawer can be moved to a small degree transversely with respect to the supporting runner 2, 14. So that this transverse movement is not hindered by the runner 1, 13, horizontal flange 40 of the runner 1 which has the narrower roller 9' is of wider construction than horizontal flange 41 which has the wider roller 9.

In the embodiment according to FIGS. 12, 13 the roller 16 is directly mounted on the supporting runner 14 in a conventional manner by means of a spindle which is for example riveted to the supporting runner 14. The supporting runner 14 is again, as in the previously described embodiment, fixed on the furniture carcass by means of two retaining plates 3, 4. Just as in the previously described embodiment the pull-out runner 13 is fixed with the horizontal fixing flange 19 on the side wall 11 of the drawer. The pull-out runner 13 on one side of the drawer differs from the preceding embodiment in that a bead 10 is provided on the running flange thereof. The bead 10, which extends over the entire length of the pull-out runner 13, has two side walls 15 which run laterally on the roller 16 and thus form a lateral guide for the pull-out guide and the drawer.

The pull-out runner 13 is provided with fins 18 which project horizontally below the running flange 27 and the edge flange 33 of the supporting runner 14 and which form a means for securing the pull-out guide 13 and thus the drawer from being lifted off.

We claim:

1. A pull-out guide fitting to be employed on a side of a drawer to guide movement of the drawer into and out of a body of an article of furniture, said fitting comprising:

a supporting runner to be mounted on the furniture body, said supporting runner including upper and lower running flanges and a running member;

a pull-out runner to be mounted on the drawer, said pull-out runner including a lower fixing flange to be connected to the drawer, a vertical flange extending upwardly from said lower fixing flange, an upper running flange extending from said vertical flange, at least one horizontal fin extending laterally from said vertical flange, and a running member;

said running member of said pull-out runner being guided between said upper and lower running flanges of said supporting runner, and said running member of said supporting runner running on said upper running flange of said pull-out runner;

said upper running flange of said pull-out runner extending above and covering said upper and lower running flanges of said supporting runner; and said horizontal fin having a free end projecting below said upper running flange of said supporting runner, thereby preventing, upon an upward force being imparted to said pull-out runner, unintentional upward lifting away of said pull-out runner from said supporting runner.

2. A fitting as claimed in claim 1, wherein said upper running flange of said pull-out runner has a longitudinal bead including laterally spaced side walls between which is guided said running member of said supporting runner.

3. A fitting as claimed in claim 1, wherein said running members comprise rollers.

4. A fitting as claimed in claim 3, further comprising a plastic block mounted on said supporting runner and having a stop projecting laterally at a level to be abutted from below by said fin, said roller of said supporting runner being mounted on said plastic block.

5. A fitting as claimed in claim 4, wherein said roller of said supporting runner is mounted between side walls of said plastic block by a spindle mounted at opposite ends thereof in said side walls.

6. A fitting as claimed in claim 4, wherein said plastic block has lateral guide surfaces to guide said pull-out runner.

7. A fitting as claimed in claim 4, wherein said lower running flange of said supporting runner has projecting therefrom horizontal fin members, and said plastic block has projections fitting beneath respective said fin members, thereby mounting said plastic block on said supporting runner.

8. A fitting as claimed in claim 7, wherein said plastic block is mounted on a front end of said supporting runner.

9. A fitting as claimed in claim 1, wherein said upper running flange of said supporting runner has a free edge flange against which abuts said fin upon application of said upward force.

10. A fitting as claimed in claim 1, further comprising separate front and rear retaining plates to mount front and rear ends, respectively, of said supporting runner to the furniture body.

11. A fitting as claimed in claim 10, wherein said rear retaining plate has upper and lower retaining tabs receiving therebetween said rear end of said supporting runner, one of said tabs having a positioning structure providing lateral support of said rear end.

12. A fitting as claimed in claim 11, wherein said positioning structure comprises two laterally spaced knobs projecting from said one tab, said rear end being positioned between said two knobs.

13. A fitting as claimed in claim 11, wherein said positioning structure comprises a projection extending from said one tab into an open-ended slot in said rear end.

14. A fitting as claimed in claim 11, wherein the other said tab has a hook fitting into a hole in said supporting runner.

15. A fitting as claimed in claim 11, wherein the other said tab is resilient.

16. A fitting as claimed in claim 15, wherein said other tab has a bend resiliently pressed toward said supporting runner.

* * * * *